United States Patent [19]

Rotella

[11] Patent Number: 4,515,364

[45] Date of Patent: May 7, 1985

[54] COMPACT EXERCISE DEVICE

[76] Inventor: Thomas B. Rotella, 22 E. 7th St., Clifton, N.J. 07011

[21] Appl. No.: 511,472

[22] Filed: Jul. 7, 1983

[51] Int. Cl.[3] ..... A63B 11/02; A63B 21/00

[52] U.S. Cl. ..... 272/143; 272/122; 272/135; 272/137

[58] Field of Search ..... 272/67-68, 272/93, 116, 122-123, 125-126, 135-137, 142-144; D21/198

[56] References Cited

U.S. PATENT DOCUMENTS 3,265,389 8/1966 Carlson ..... 272/68
4,384,714 5/1983 Kimura ..... 272/119

FOREIGN PATENT DOCUMENTS 532943 2/1930 Fed. Rep. of Germany ..... 272/142
2123612 12/1972 Fed. Rep. of Germany ..... 272/68

*Primary Examiner*—Robert A. Hafer
*Assistant Examiner*—Chris Coppens
*Attorney, Agent, or Firm*—Samuelson & Jacob

[57] ABSTRACT

An exercise device has an elastomeric frame of limited dimensions with openings enabling manipulation of the frame in a plurality of modes for various exercise routines, and weights selectively secured within some of the openings to establish a compact dumb-bell assembly for use in some of the exercise routines.

20 Claims, 10 Drawing Figures

COMPACT EXERCISE DEVICE

The present invention relates generally to exercise devices and pertains, more specifically, to relatively small, compact exercise devices of the type to be gripped and manipulated for exercising various parts of the body.

The current emphasis upon physical fitness has spawned an increasing number and variety of exercise devices designed to facilitate exercising routines and render such routines more effective in terms of maintaining the exerciser's interest as well as attaining maximum beneficial conditioning of the exerciser's body.

It is an object of the present invention to provide a relatively small, compact exercise device which is highly versatile, enabling a user to gain beneficial conditioning of various parts of the user's body with ease and convenience.

Another object of the invention is to provide an exercise device of the type described and which tends to maintain the interest of the user so as to reduce the monotony which so often accompanies exercise routines.

Still another object of the invention is to provide an exercise device of the type described and which is portable enough to accompany the user for availability whenever the user finds an opportunity for even a limited exercise routine.

Yet another object of the invention is to provide an exercise device of the type described and which is exceptionally simple to use in a wide variety of exercise manipulations.

A further object of the invention is to provide an exercise device of the type described and which is so simple in design and construction as to encourage its use in the many modes made available by it to the user.

A still further object of the invention is to provide an exercise device of the type described and which is relatively inexpensive so as to make it available readily to a large number of users.

The above objects, as well as still further objects and advantages, are attained by the present invention, which may be described briefly as an exercise device comprising: a generally polygonal frame of elastomeric material, the frame including a pair of first bars extending generally parallel to one another along first opposite sides of the frame; a pair of second bars extending generally parallel to one another along second opposite sides of the frame; a generally central third bar located intermediate the first and second bars; and web members interconnecting the third bar with at least some of the first and second bars to establish openings in the frame between the third bar and each of the first and second bars such that the frame may be gripped at any of the first, second and third bars for resilient deformation of the frame. Weights are selectively placed in some of the openings to establish a dumb-bell assembly.

The invention will be understood more fully, while still further objects and advantages will become apparent, in the following detailed description of a preferred embodiment of the invention illustrated in the accompanying drawing, in which.

Figure 1:
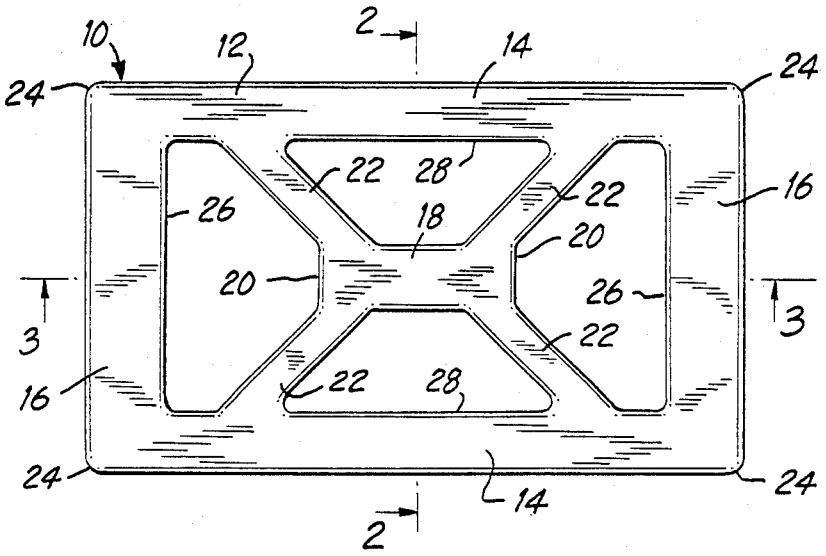
FIG. 1 is a plan view of an exercise device constructed in accordance with the invention.
Figure 2:
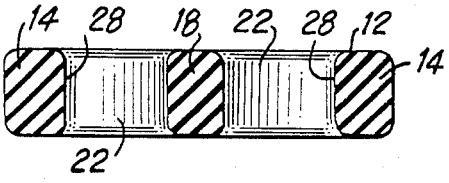
FIG. 2 is a cross-sectional view taken along line 2—2 of FIG. 1.
Figure 3:
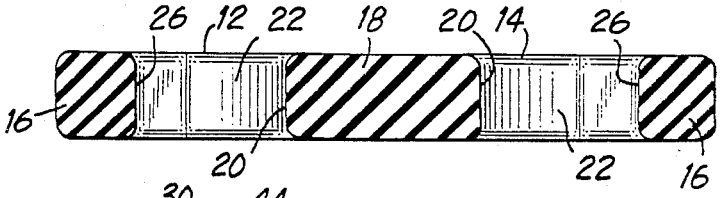
FIG. 3 is a cross-sectional view taken along line 3—3 of FIG. 1.

Referring now to the drawing, and especially to FIGS. 1, 2 and 3 thereof, an exercise device 10 is shown constructed in accordance with the invention and is seen to include a frame 12 constructed of an elastomer so as to be resiliently deformable. Preferably, frame 12 is molded in a unitary construction and the elastomer is chosen from among those materials having an appropriate balance between resilience and stiffness, such as a high tensile strength rubber, to perform the functions set forth in detail below.

Frame 12 has a generally polygonal plan configuration shown in the form of a rectangle including a pair of parallel opposite longitudinal bars 14 and a pair of parallel opposite lateral bars 16. A central bar 18 extends in a longitudinal direction intermediate the bars 14 and 16 and includes opposite ends 20 spaced longitudinally from lateral bars 16. Two web members 22 extend from each end 20 toward corners 24 formed at the intersections between the respective bars 14 and 16 so as to interconnect the central bar 18 with the longitudinal and lateral bars 14 and 16 to complete the unitary construction of frame 12 and to establish end openings 26 adjacent the ends 20 and side openings 28 adjacent the sides of the central bar 18. The arrangement of web members 22 provides the openings 26 and 28 with trapezoid-like peripheral configurations. As best seen in FIGS. 2 and 3, frame 12 is relatively flat in elevation, so that exercise device 10 maintains a minimum thickness. Thus, the typical overall dimensions of exercise device 10 are held to about five inches in width, nine inches in length and one inch in thickness (about the size of an average book) rendering the exercise device easily carried, such as in a briefcase.

Figure 4:
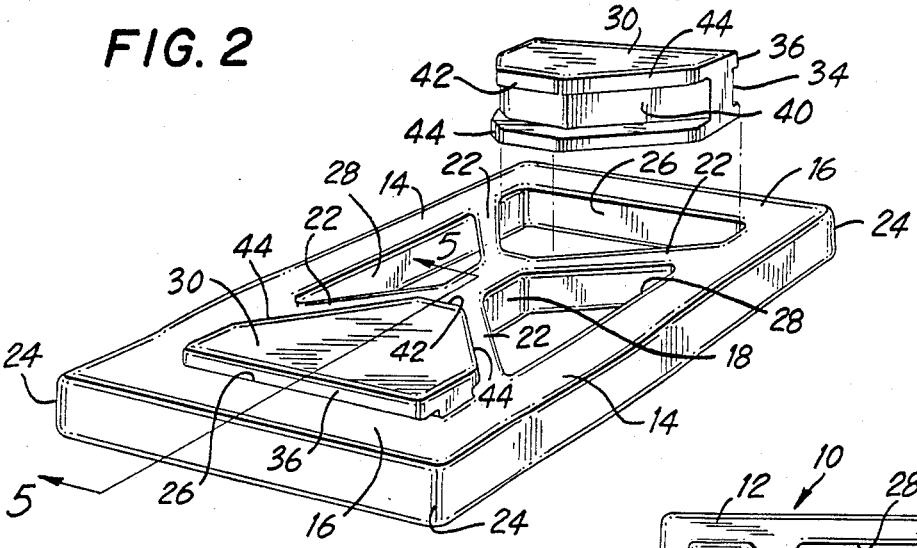
FIG. 4 is an exploded perspective view of the exercise device illustrating the use of weights in the device.
Figure 5:
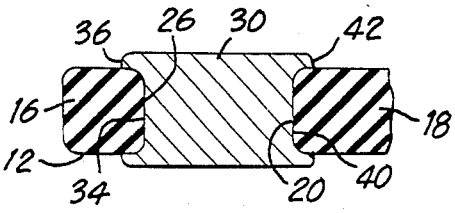
FIG. 5 is a fragmentary cross-sectional view taken along line 5—5 of FIG. 4.
Figure 6:
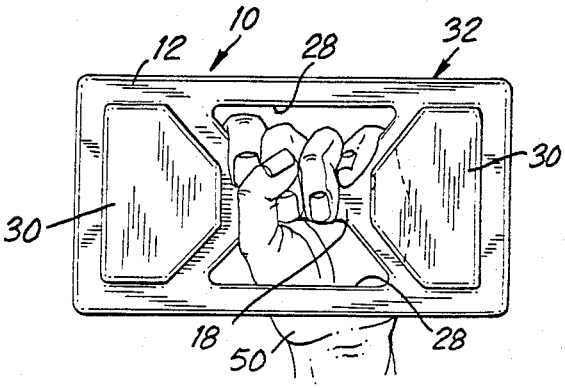
FIGS. 6 through 10 are pictorial views illustrating various modes of use of the exercise device.

Turning now to FIGS. 4 and 5, a pair of weights 30 selectively are fitted into end openings 26 of frame 12 and secured therein to form a dumb-bell assembly 32 which is gripped along central bar 18, as seen in FIG. 6. Thus, central bar 18 serves as a lifting handle for the assembled frame 12 and weights 30 so that the assembly 32 may be manipulated as a conventional dumb-bell. By choosing weights 30 of various magnitudes, the weight of dumb-bell assembly 32 may be selected for the particular needs of the user.

Weights 30 preferably are constructed of a relatively heavy material, such as cast iron, and are secured within frame 12 by a simple interlocking structure. Thus, each weight 30 as a trapezoid-like peripheral configuration essentially complementary to the peripheral configuration of a corresponding opening 26. A first channel 34 extends along a first leg 36 of the periphery of the weight 30 while a second channel 40 extends along further legs 42 and 44 of the periphery of the weight 30. The relative dimensions of the weights 30 and the openings 26 are such that the bars 14, 16 and 18 and web members 22 surrounding the openings 26 will be stretched resiliently to dilate each opening 26 so as to admit a weight 30. The channels 34 and 40 have a cross-sectional configuration complementary to the corresponding cross-sectional configurations of the bars 14, 16 and 18 and web members 22 so that upon contraction of each opening 26 around a weight 30 the corresponding bars and web members will be seated within the channels 34 and 40, as seen in FIG. 5, to secure the weights 30 in place in the dumb-bell assembly 32. The construction and configuration of the weights 30 maintain the desired flat, relatively thin elevational profile of exercise device 10, while the securing arrangement enables the weights to be inserted and removed with ease, for ready selection of the appropriate amount of weight.

Exercise device 10 may be utilized in a variety of different exercise routines, only some of which are illustrated herein. Thus, as seen in FIG. 6, exercise device 10 serves as dumb-bell of selected weight, capable of being utilized in all of the exercise routines designed for dumb-bell manipulation.

Figure 7:
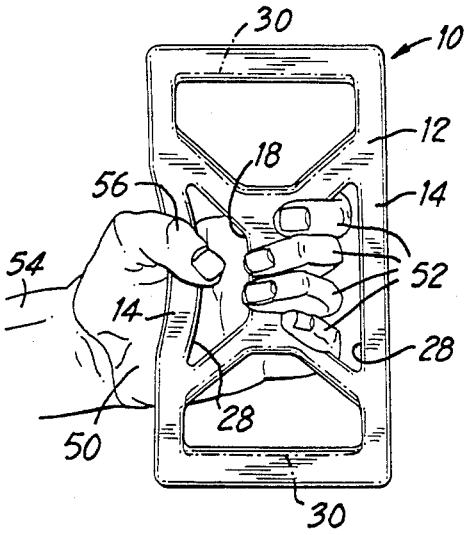

In FIG. 7, exercise device 10 is shown being utilized as a hand exerciser. In the illustrated mode of operation, the resilience of frame 12, and, in particular, the resilience of one of the longitudinal bars 14 and central bar 18, provides the resistance to deformation necessary to exercise the hand 50 as the hand 50 squeezes the exercise device 10. In the mode shown, one side opening 28 admits the fingers 52 of hand 50 while the other side opening 28 contracts and expands to exercise the hand 50. The exercise routine may be carried with or without weights 30, the presence of weights 30 enabling simultaneous exercise of the arm 54.

Figure 8:
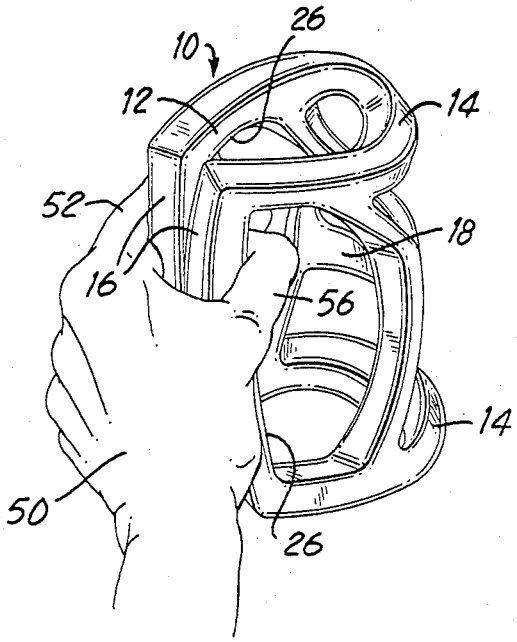

In FIG. 8, exercise device 10 is employed in a mode which takes advantage of the resilience of frame 12 as the frame is flexed about a lateral axis. In this mode, one of the end openings 26 admits the fingers 52 of hand 50 while the other end opening 26 admits the thumb 56 so that the hand squeezes the lateral bars 16 toward one another while the longitudinal bars 14 and central bar 18 deform to flex with sufficient resistance to exercise the hand 50.

Figure 9:
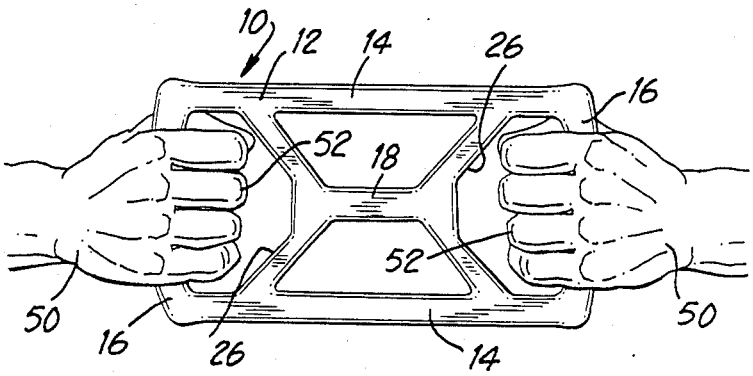

In FIG. 9, exercise device 10 is used in a mode in which frame 12 is deformed so that the frame is stretched longitudinally to exercise the user's arms and body. A hand 50 grips each lateral bar 16, utilizing end openings 26 to admit the fingers 52 of the hands 50, and the longitudinal bars 14 and central bar 18 of frame 12 are placed in tension.

Figure 10:
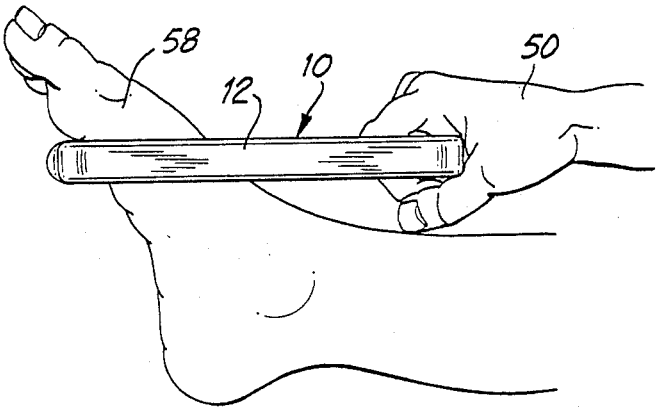

In FIG. 10, exercise device 10 is used in a mode in which frame 12 is stretched longitudinally to exercise the user's arm and leg, as well as body. Here, one end opening 26 admits the user's foot 58 while the other end opening 26 admits the user's hand 50 to enable the longitudinal bars 14 and central bar 18 to be placed in tension.

Thus, it will be seen that exercise device 10 provides a compact, simple and efficient system for use in a wide variety of modes, enabling a user to obtain beneficial conditioning with ease and convenience. The system is highly portable and very inexpensive. The relatively thin elevational profile enables the exercise device to be carried about readily, as in a brief case, the overall dimensions of the device being approximately the same as that of an average book.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are as follows:

1. An exercise device comprising:

a generally polygonal frame of elastomeric material, the frame including a pair of first bars extending generally parallel to one another along first opposite sides of the frame;

a pair of second bars extending generally parallel to one another along second opposite sides of the frame;

a generally central third bar located intermediate the first and second bars;

web members interconnecting the third bar with at least some of the first and second bars to establish openings in the frame between the third bar and each of the first and second bars such that the frame may be gripped at any of the first, second and third bars for resilient deformation of the frame; and weights selectively secured within some of the openings.

2. The invention of claim 1 wherein the third bar is generally parallel to the first bars.

3. The invention of claim 2 wherein the polygonal frame has a generally rectangular plan configuration, while the first bars intersect the second bars at corners, and is relatively thin in elevation.

4. The invention of claim 3 wherein the third bar has opposite ends and each end is spaced from a corresponding second bar.

5. The invention of claim 4 wherein the web members extend from the opposite ends of the third bar toward the first bars.

6. The invention of claim 5 wherein the web members extend toward each corner such that the openings have a generally trapezoid-like configuration.

7. The invention of claim 1, 2, 3, 4, 5 or 6 wherein the weights each have a peripheral configuration generally complementary to the peripheral configuration of a corresponding opening, the weights including securing means for interengaging with complementary portions of the frame to secure the weights in place.

8. The invention of claim 7 wherein the corresponding openings within which the weights are secured are located between a second bar and the third bar.

9. The invention of claim 8 wherein the securing means includes a channel in portions of the weight for receiving corresponding portions of the frame in seated relationship therein.

10. The invention of claim 1, 2, 3, 4, 5 or 6 wherein the frame is a unitary construction.

11. The invention of claim 10 wherein the weights each have a peripheral configuration generally complementary to the peripheral configuration of a corresponding opening, the weights including securing means for interengaging with complementary portions of the frame to secure the weights in place.

12. The invention of claim 11 wherein the corresponding openings within which the weights are secured are located between a second bar and the third bar.

13. The invention of claim 12 wherein the securing means includes a channel in portions of the weight for receiving corresponding portions of the frame in seated relationship therein.

14. In an exercise device:

a frame having at least a frame portion of resilient material;

a lifting handle integral with the frame, the lifting handle having opposite ends and extending from said frame portion;

a resiliently dilatable opening in the frame portion adjacent at least one of the opposite ends of the lifting handle, the opening having a given peripheral configuration; and a weight having a periphery with a peripheral configuration including at least a portion complementary to a corresponding portion of the peripheral configuration of the opening;

the relative dimensions of the corresponding portions of the opening and the weight being such that the opening will dilate resiliently to admit the weight and will contract resiliently to interengage the corresponding portions of the weight and the opening and secure the weight within the frame adjacent said one of the opposite ends of the lifting handle for manipulation of the frame and the weight therein.

15. The invention of claim 14 wherein the frame includes a resiliently dilatable opening adjacent each of the opposite ends whereby securing a weight in each opening establishes a dumb-bell assembly.

16. The invention of claim 15 wherein the frame has a relatively thin, generally rectangular configuration and the weights include a generally thin configuration to maintain a relatively thin configuration in the dumb-bell assembly.

17. The invention of claim 14, 15 or 16 wherein the portion of the peripheral configuration of the weight includes a channel complementary to the corresponding portion of the peripheral configuration of the opening.

18. The invention of claim 14, 15 or 16 wherein the frame is a unitary elastomeric construction.

19. The invention of claim 18 wherein the portion of the peripheral configuration of the weight includes a channel complementary to the corresponding portion of the peripheral configuration of the opening.

20. An exercise device comprising:

a frame of elastomeric material, the frame having a generally rectangular plan configuration and being relatively thin in elevation, the frame including a pair of first bars extending generally parallel to one another along first opposite sides of the frame;

a pair of second bars extending generally parallel to one another along second opposite sides of the frame and intersecting the first bars at corners;

a generally central third bar located intermediate the first and second bars and extending generally parallel to the first bars between opposite ends, each of said opposite ends being spaced from a corresponding second bar; and web members interconnecting the third bar with at least some of the first and second bars to establish openings in the frame between the third bar and each of the first and second bars such that the frame may be gripped at any of the first, second and third bars for resilient deformation of the frame, the web members extending from the opposite ends of the third bar, at an acute angle to the first and second bars, toward each corner such that the openings have a generally trapezoid-like configuration.

* * * * *